US012366185B2

(12) United States Patent
Yamamoto

(10) Patent No.: US 12,366,185 B2
(45) Date of Patent: Jul. 22, 2025

(54) POWER TRANSMISSION DEVICE

(71) Applicant: TOYOTA JIDOSHA KABUSHIKI KAISHA, Toyota (JP)

(72) Inventor: Hiroshi Yamamoto, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/354,753

(22) Filed: Jul. 19, 2023

(65) Prior Publication Data

US 2024/0102404 A1 Mar. 28, 2024

(30) Foreign Application Priority Data

Sep. 26, 2022 (JP) ..... 2022-152332

(51) Int. Cl.
*F01M 11/00* (2006.01)

(52) U.S. Cl.
CPC . *F01M 11/0004* (2013.01); *F01M 2011/0025* (2013.01); *F01M 2011/0045* (2013.01); *F01M 2011/0066* (2013.01)

(58) Field of Classification Search
CPC ..... F01M 11/0004; F01M 2011/0025; F01M 2011/0037; F01M 2011/0045; F01M 2011/0066; F16H 57/0409; F16H 57/045; F16H 57/0452; F16H 57/0453; F16H 57/0457
See application file for complete search history.

(56) References Cited

U.S. PATENT DOCUMENTS 6,299,561 B1 * 10/2001 Kramer ..... F16H 57/0447 184/6.12
6,644,439 B2 * 11/2003 Schnitzer ..... F16H 57/0456 184/6.12
9,297,322 B2 * 3/2016 Hokuto ..... F02D 41/22
10,738,878 B2 * 8/2020 Kiyokami ..... F16H 57/0441
2008/0210491 A1 * 9/2008 Mori ..... F01M 11/0004 184/106

(Continued)

FOREIGN PATENT DOCUMENTS

DE 10308560 B4 2/2006
JP 2020-91001 A 6/2020

(Continued)

OTHER PUBLICATIONS

Translation of Feb. 27, 2025 Office Action issued in Korean Application 10-2023-0095164.

*Primary Examiner* — Minh Truong
(74) *Attorney, Agent, or Firm* — Oliff PLC

(57) ABSTRACT

A power transmission device includes: a case including a first oil reservoir configured to store oil, a second oil reservoir configured to store the oil, and a partition wall configured to separate the first oil reservoir and the second oil reservoir from each other; the oil enclosed in the case; a rotating member configured to contact the oil in the first oil reservoir; and an opening and closing member located in the partition wall and configured to supply the oil from the second oil reservoir to the first oil reservoir. The oil level in the first oil reservoir when the opening and closing member is open is higher than the oil level in the first oil reservoir when the opening and closing member is closed, and is high enough for at least a part of the rotating member to be dipped in the oil.

6 Claims, 2 Drawing Sheets

(56) References Cited

U.S. PATENT DOCUMENTS

| | | | | |
|---|---|---|---|---|
| 2011/0162482 | A1* | 7/2011 | Jacobs | F16H 57/0447 74/606 R |
| 2016/0237867 | A1* | 8/2016 | Zahdeh | F01M 11/0004 |
| 2017/0292602 | A1 | 10/2017 | Chen et al. | |
| 2018/0294693 | A1* | 10/2018 | Yu | H02K 9/19 |
| 2023/0030818 | A1* | 2/2023 | Biehler | F16H 57/0436 |
| 2023/0204096 | A1* | 6/2023 | Jinnai | F16H 1/00 180/53.1 |

FOREIGN PATENT DOCUMENTS

| | | | | |
|---|---|---|---|---|
| JP | 2020091001 | A | * | 6/2020 |
| KR | 20-0129339 | Y1 | | 5/1999 |

* cited by examiner

POWER TRANSMISSION DEVICE

CROSS-REFERENCE TO RELATED APPLICATION

This application claims priority to Japanese Patent Application No. 2022-152332 filed on Sep. 26, 2022 incorporated herein by reference in its entirety.

BACKGROUND

1. Technical Field

The present disclosure relates to power transmission devices.

2. Description of Related Art

For example, Japanese Unexamined Patent Application Publication No. 2020-91001 (JP 2020-91001 A) discloses a power transmission device including a case, oil, a rotating member, a scavenging pump, a feeding pump, and an oil cooler. The case has a first chamber, a second chamber, and a partition wall separating the first and second chambers from each other. The rotating member is disposed in the first chamber. The oil in the first chamber is sent to the second chamber by the scavenging pump, and the oil in the second chamber is sent to the oil cooler by the feeding pump. The oil flowing out of the oil cooler is supplied to the rotating member, gears, etc., and flows into each chamber.

SUMMARY

In the power transmission device described in JP 2020-91001 A, when, for example, the temperature of the oil is low, the viscosity of the oil is high, and it is therefore desirable to quickly increase the temperature of the oil.

The present disclosure provides a power transmission device capable of reducing the time required to increase the temperature of oil.

An aspect of the present disclosure relates to a power transmission device including a case, oil, a rotating member, and an opening and closing member. The case includes a first oil reservoir configured to store the oil, a second oil reservoir configured to store the oil, and a partition wall configured to separate the first oil reservoir and the second oil reservoir from each other. The oil is enclosed in the case. The rotating member is configured to contact the oil in the first oil reservoir. The opening and closing member is located in the partition wall and is configured to supply the oil from the second oil reservoir to the first oil reservoir. An oil level in the first oil reservoir when the opening and closing member is open is higher than an oil level in the first oil reservoir when the opening and closing member is closed, and is high enough for at least a part of the rotating member to be dipped in the oil.

According to the power transmission device of the present disclosure, it is possible to reduce the time required to increase the temperature of the oil.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Embodiments of the present disclosure will be described with reference to the drawings. The same or corresponding members are denoted by the same signs throughout the drawings that will be referred to below.

Figure 1:
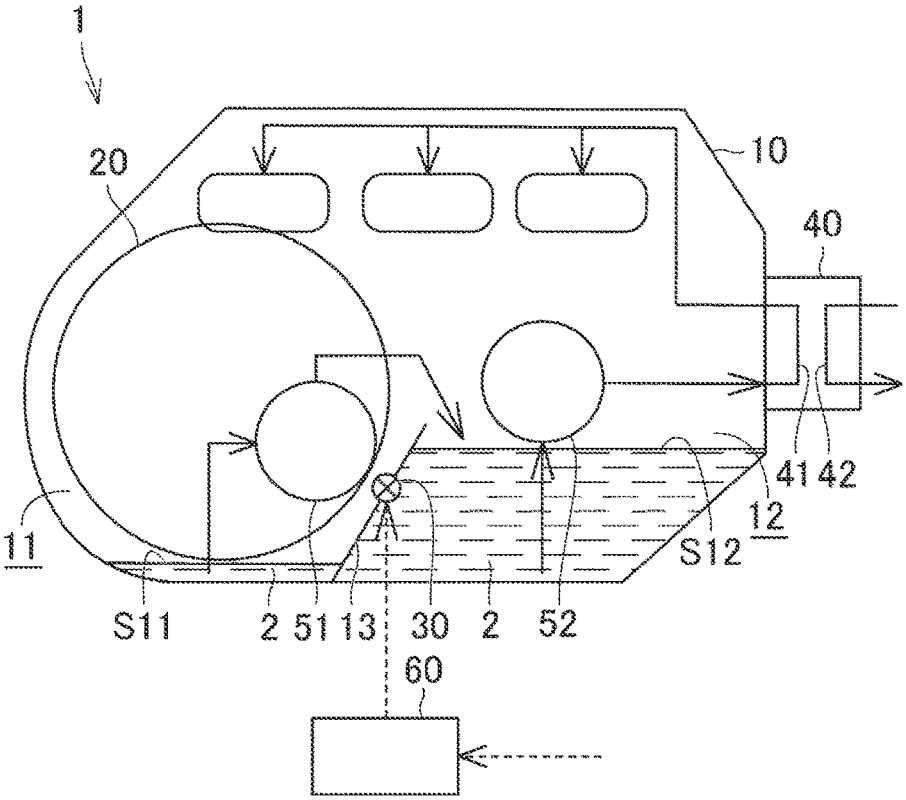
FIG. 1 schematically shows a power transmission device according to a first embodiment of the present disclosure.

A first embodiment of the present disclosure will be described below. FIG. 1 schematically shows a power transmission device according to the first embodiment of the present disclosure. A power transmission device 1 is applied to a transaxle mounted on a vehicle and a drive unit with a built-in motor. The power transmission device 1 transmits torque output from a power source (not shown) to an output member such as a drive shaft.

As shown in FIG. 1, the power transmission device 1 includes a case 10, a rotating member 20, an opening and closing member 30, an oil cooler 40, a first feeding unit 51, a second feeding unit 52, and a control unit 60. FIG. 1 shows the power transmission device 1 when it is in steady operation or stopped.

The case 10 is the outer shell of the power transmission device 1. Oil 2 is enclosed in the case 10. The case 10 has a first oil reservoir 11, a second oil reservoir 12, and a partition wall 13.

The first oil reservoir 11 can store the oil 2. The first oil reservoir 11 is formed in the lower part of the case 10.

The second oil reservoir 12 can store the oil 2. The second oil reservoir 12 is formed in the lower part of the case 10. In the present embodiment, the second oil reservoir 12 is located adjacent to the first oil reservoir 11.

The partition wall 13 separates the first oil reservoir 11 and the second oil reservoir 12 from each other.

The rotating member 20 is disposed in the first oil reservoir 11. The rotating member 20 is a member that rotates in the first oil reservoir 11 while being supplied with the oil 2. Examples of the rotating member 20 include a motor generator, a motor, gears, and bearings. As shown in FIG. 1, the rotating member 20 is disposed at a position higher than an oil level S11 in the first oil reservoir 11 when the power transmission device 1 is in steady operation or stopped. The rotating member 20 therefore rotates in the first oil reservoir 11 substantially without being subjected to the stirring resistance of the oil 2. The rotating member 20 can contact the oil 2 in the first oil reservoir 11.

The opening and closing member 30 is provided in the partition wall 13. The opening and closing member 30 is provided at a position higher than the lower end of the rotating member 20 in the partition wall 13. The opening and closing member 30 is, for example, a solenoid valve. When the opening and closing member 30 is opened, the first oil reservoir 11 and the second oil reservoir 12 communicate with each other. When the opening and closing member 30 is closed, the first oil reservoir 11 and the second oil reservoir 12 are disconnected from each other. The opening and closing member 30 is closed when the power transmission device 1 is in steady operation or is stopped. As shown in FIG. 1, the opening and closing member 30 is disposed at a position lower than an oil level S12 in the second oil reservoir 12 when the power transmission device 1 is in steady operation or stopped. When the opening and closing member 30 is closed (when the power transmission device 1 is in steady operation or stopped), the oil level S12 in the second oil reservoir 12 is higher than the oil level S11 in the first oil reservoir 11. The opening and closing member 30 can supply the oil 2 from the second oil reservoir 12 to the first oil reservoir 11. Specifically, the opening and closing member 30 can be switched between an open state in which the oil 2 in the second oil reservoir 12 is allowed to flow into the first oil reservoir 11 and a disconnected state in which the oil 2 in the second oil reservoir 12 is not allowed to flow into the first oil reservoir 11.

The oil cooler 40 is provided outside the case 10. The oil cooler 40 can cool the oil 2 by causing a cooling medium and the oil 2 to exchange heat with each other. The oil cooler 40 has an oil channel 41 through which the oil 2 flows, and a cooling medium channel 42 through which the cooling medium flows. The cooling medium flowing out of the cooling medium channel 42 is supplied to a heater, a battery, etc.

The first feeding unit 51 feeds the oil 2 in the first oil reservoir 11 to the second oil reservoir 12. In the present embodiment, the first feeding unit 51 is a scavenging pump. However, the first feeding unit 51 is not limited to the scavenging pump.

The second feeding unit 52 feeds the oil 2 in the second oil reservoir 12 to the oil cooler 40. The second feeding unit 52 is, for example, an oil pump. The oil 2 flowing out of the second feeding unit 52 flows into the oil channel 41 of the oil cooler 40. The oil 2 flowing out of the oil channel 41 is supplied from the upper part of the case 10 to the rotating member 20 and other gears and flows into the oil reservoirs 11, 12. That is, the inside of the first oil reservoir 11 is in a so-called dry sump state.

The control unit 60 controls opening and closing of the opening and closing member 30. The control unit 60 opens the opening and closing member 30 when an opening condition for opening the opening and closing member 30 is satisfied. For example, the control unit 60 determines that the opening condition is satisfied when the control unit 60 receives a request from a device to which the cooling medium flowing out of the oil cooler 40 is to be supplied (such as when the control unit 60 receives a signal that is output when a heater switch is turned on, a signal that is output when battery warm-up is started, etc.). It is preferable that the control unit 60 open the opening and closing member when the rotating member 20 rotates.

The control unit 60 closes the opening and closing member 30 when a closing condition for closing the opening and closing member 30 is satisfied. For example, the control unit 60 determines that the closing condition is satisfied when the request from the device is stopped (such as when the control unit 60 receives a signal that is output when the heater switch is turned off, a signal that is output when the battery warm-up is finished, etc.).

Next, operation of the power transmission device 1 will be described.

The opening and closing member 30 is closed (in the disconnected state) when the power transmission device 1 is in steady operation or stopped. At this time, the oil level S12 in the second oil reservoir 12 is higher than the oil level S11 in the first oil reservoir 11. Specifically, as shown in FIG. 1, the oil level S11 in the first oil reservoir 11 is low enough for the oil 2 not to be in contact with the rotating member 20 or for the oil 2 to be only slightly in contact with the rotating member 20, and the oil level S12 in the second oil reservoir 12 is located above the opening and closing member 30.

Figure 2:
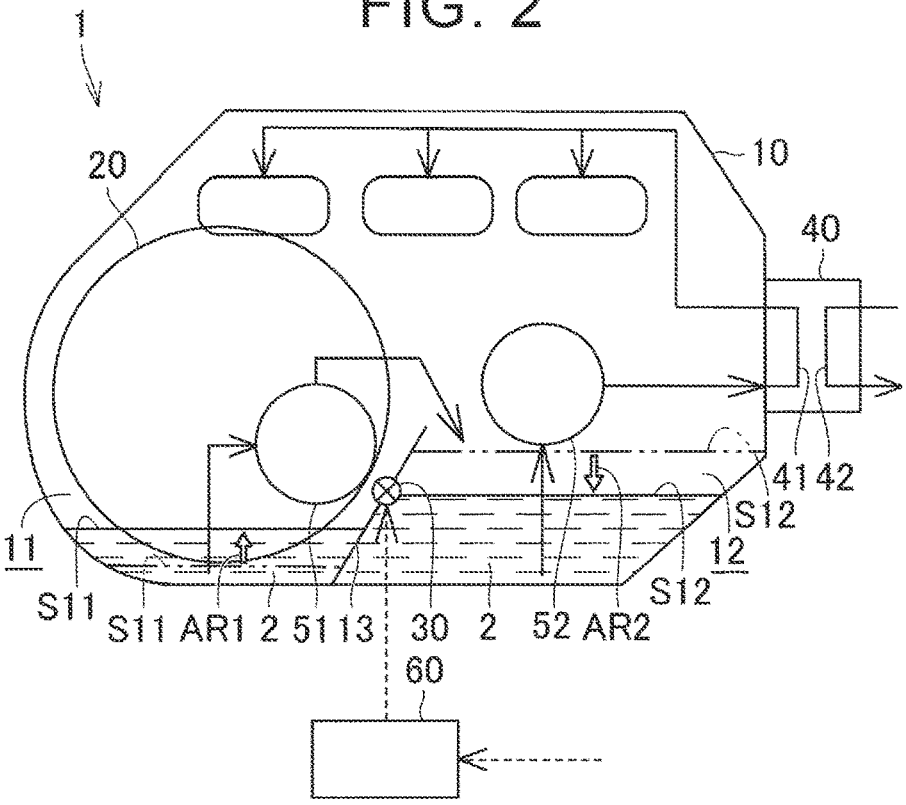
FIG. 2 schematically shows the power transmission device when an opening and closing member is open.

In this state, the control unit 60 opens the opening and closing member 30 (switches the opening and closing member 30 to the open state) when the control unit 60 receives a request from the device (e.g., when the control unit 60 receives a signal that is output when the heater switch is turned on). The oil 2 in the second oil reservoir 12 thus flows into the first oil reservoir 11. As a result, as shown in FIG. 2, the oil level S12 in the second oil reservoir 12 drops as shown by arrow AR2, while the oil level S11 in the first oil reservoir 11 rises as shown by arrow AR1. In FIG. 2, the oil levels S11, S12 before the opening and closing member 30 is opened are shown by long dashed double-short dashed lines.

As a result, at least a part (lower part) of the rotating member 20 is dipped in the oil 2, so that the contact area between the rotating member 20 and the oil 2 increases. Therefore, the stirring resistance of the oil 2 by the rotating member 20 increases. Accordingly, the temperature of the oil 2 in the first oil reservoir 11 increases. Since the oil 2 in the first oil reservoir 11 is sent to the second oil reservoir 12 by the first feeding unit 51, the temperature of the oil 2 in the second oil reservoir 12 also increases. Therefore, the temperature of the oil 2 sent to the oil channel 41 of the oil cooler 40 also increases, so that the temperature of the cooling medium flowing out of the cooling medium channel 42 increases quickly.

Subsequently, the control unit 60 closes the opening and closing member (switches the opening and closing member 30 to the disconnected state) when the request from the device is stopped (e.g., when the control unit 60 receives a signal that is output when the heater switch is turned off). As a result, the oil levels S11, S12 in the first and second oil reservoirs 11, 12 are restored to, for example, the levels when the power transmission device 1 is in steady operation or stopped.

As described above, in the power transmission device 1 according to the present embodiment, the oil 2 in the second oil reservoir 12 flows into the first oil reservoir 11 when the opening and closing member 30 is opened. Therefore, the temperature of the oil 2 in the first oil reservoir 11 increases due to the rotation of the rotating member 20. The oil 2 in the first oil reservoir 11 flows into the oil cooler 40 via the second oil reservoir 12. In the oil cooler 40, the oil 2 exchanges heat with the cooling medium. The time required to increase the temperature of the cooling medium flowing out of the oil cooler 40 can thus be reduced.

Next, a second embodiment of the present disclosure will be described. The power transmission device 1 according to the second embodiment of the present disclosure will be described with reference to FIG. 3. In the second embodiment, only portions different from the first embodiment will be described, and description of the same structures, functions, and effects as those of the first embodiment will not be repeated.

In the present embodiment, the second oil reservoir 12 is located above the first oil reservoir 11. The first feeding unit 51 is formed by the rotating member 20. As shown by arrow AR3 in FIG. 3, the rotating member 20 picks up the oil 2 in the first oil reservoir 11 and carries the oil 2 toward the second oil reservoir 12.

In the present embodiment, the partition wall 13 defines the second oil reservoir 12. The partition wall 13 has a shape that opens upward. The partition wall 13 has a bottom portion 13*a* and a peripheral wall portion 13*b*. The bottom portion 13*a* is in the form of a flat plate. The peripheral wall portion 13*b* stands from the edge of the bottom portion 13*a* and is formed in an annular shape.

The peripheral wall portion 13*b* includes an overlap portion 13*c*. The overlap portion 13*c* is located above the rotating member 20 in the vertical direction. The overlap portion 13*c* has such a shape that it is tilted from the bottom portion 13*a* so as to gradually approach the rotating member 20 as it gets closer to the upper end of the overlap portion 13*c*. The upper end of the overlap portion 13*c* is located below the upper end of the rotating member 20.

Figure 3:
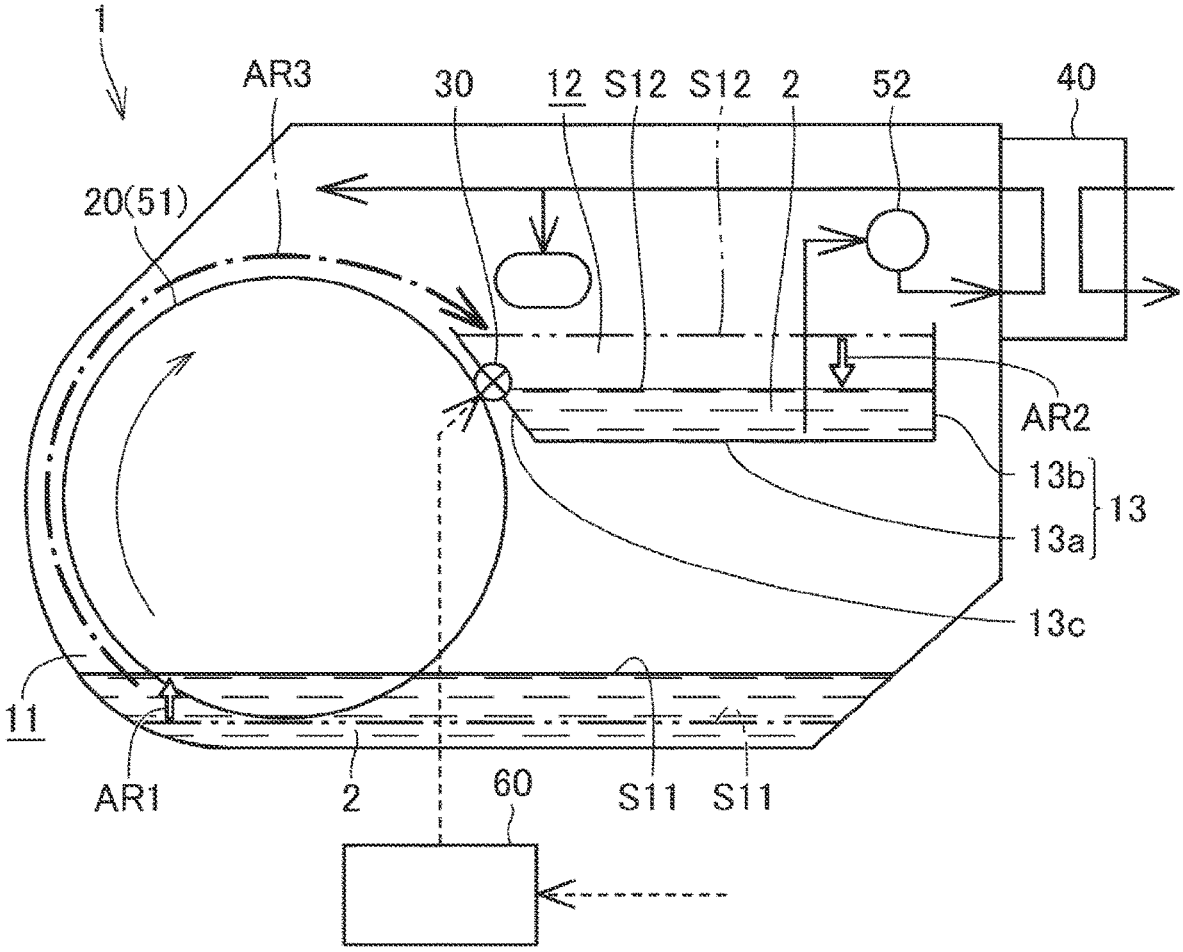
FIG. 3 schematically shows a power transmission device according to a second embodiment of the present disclosure.

The opening and closing member 30 is provided in the overlap portion 13*c*. In FIG. 3, the oil levels S11, S12 when the opening and closing member 30 is open are shown by continuous lines, and the oil levels S11, S12 before the opening and closing member 30 is opened are shown by long dashed double-short dashed lines.

In this aspect, since the rotating member 20 also serves as the first feeding unit 51, it is possible to omit a dedicated device (such as an oil pump) for feeding the oil 2 from the first oil reservoir 11 to the second oil reservoir 12.

It will be appreciated by those skilled in the art that the above exemplary embodiments are specific examples of the aspect and configurations that will be described below.

A aspect of the present disclosure will be described. A power transmission device includes: a case including a first oil reservoir configured to store oil, a second oil reservoir configured to store the oil, and a partition wall configured to separate the first oil reservoir and the second oil reservoir from each other; the oil enclosed in the case; a rotating member configured to contact the oil in the first oil reservoir; and an opening and closing member located in the partition wall and configured to supply the oil from the second oil reservoir to the first oil reservoir. An oil level in the first oil reservoir when the opening and closing member is open is higher than an oil level in the first oil reservoir when the opening and closing member is closed, and is high enough for at least a part of the rotating member to be dipped in the oil.

In the power transmission device of the aspect, the oil in the second oil reservoir flows into the first oil reservoir when the opening and closing member is opened. Therefore, the temperature of the oil in the first oil reservoir increases due to rotation of the rotating member.

In the power transmission device according to the aspect, a first feeding unit configured to feed the oil in the first oil reservoir to the second oil reservoir may be further provided.

In the power transmission device according to the aspect, the second oil reservoir may be located above the first oil reservoir, and the rotating member may be configured to pick up the oil in the first oil reservoir and carry the oil toward the second oil reservoir.

In the aspect, since the oil in the first oil reservoir is sent to the second oil reservoir by the rotating member, it is possible to omit a dedicated device (such as an oil pump) for feeding the oil from the first oil reservoir to the second oil reservoir.

In the power transmission device configured as described above, the partition wall may include an overlap portion located above the rotating member in a vertical direction, and the opening and closing member may be located in the overlap portion.

In the power transmission device configured as described above, when the opening and closing member is opened, the oil in the second oil reservoir drops so as to come into contact with the rotating member. Therefore, the stirring resistance of the oil caused by the rotating member tends to increase. Accordingly, the temperature of the oil in the first oil reservoir is effectively increased.

The power transmission device according to the aspect may further include an oil cooler located outside the case and configured to cool the oil by causing the oil and a cooling medium to exchange heat with each other.

In the aspect, the cooling medium flowing into the oil cooler exchanges heat with the oil heated by the rotation of the rotating member within the case. The time required to increase the temperature of the cooling medium flowing out of the oil cooler can thus be reduced.

The power transmission device configured as described above may further include a second feeding unit configured to feed the oil in the second oil reservoir to the oil cooler.

The power transmission device configured as described above may further include a control unit configured to control opening and closing of the opening and closing member, and the control unit may be configured to open the opening and closing member when an opening condition for opening the opening and closing member is satisfied, and may be configured to close the opening and closing member when a closing condition for closing the opening and closing member is satisfied.

The power transmission device according to the aspect may further include a control unit configured to control opening and closing of the opening and closing member, and the control unit may be configured to open the opening and closing member when the control unit receives a request from a device to which the cooling medium flowing out of the oil cooler is to be supplied.

The embodiment disclosed herein should be construed as illustrative in all respects and not restrictive. The scope of the disclosure is defined by the claims rather than by the above description of the embodiment, and is intended to include all modifications within the meaning and scope equivalent to those of the claims.

What is claimed is:

1. A power transmission device, comprising:

a case including a first oil reservoir configured to store oil, a second oil reservoir configured to store the oil, and a partition wall configured to separate the first oil reservoir and the second oil reservoir from each other;

the oil enclosed in the case;

a rotating member configured to contact the oil in the first oil reservoir;

an opening and closing member located in the partition wall and configured to supply the oil from the second oil reservoir to the first oil reservoir;

an oil cooler located outside the case and configured to cool the oil by causing the oil and a cooling medium to exchange heat with each other; and a control unit configured to control opening and closing of the opening and closing member, wherein an oil level in the first oil reservoir when the opening and closing member is open is higher than an oil level in the first oil reservoir when the opening and closing member is closed, and is high enough for at least a part of the rotating member to be dipped in the oil, and the control unit is configured to open the opening and closing member when the control unit receives a request from a device to which the cooling medium flowing out of the oil cooler is to be supplied.

2. The power transmission device according to claim 1, further comprising a first feeding unit configured to feed the oil in the first oil reservoir to the second oil reservoir.

3. The power transmission device according to claim 1, wherein:

the second oil reservoir is located above the first oil reservoir; and the rotating member is configured to pick up the oil in the first oil reservoir and carry the oil toward the second oil reservoir.

4. The power transmission device according to claim 3, wherein:

the partition wall includes an overlap portion located above the rotating member in a vertical direction; and the opening and closing member is located in the overlap portion.

5. The power transmission device according to claim 1 further comprising a second feeding unit configured to feed the oil in the second oil reservoir to the oil cooler.

6. The power transmission device according to claim 1, wherein the control unit is further configured to open the opening and closing member when an opening condition for opening the opening and closing member is satisfied, and is further configured to close the opening and closing member when a closing condition for closing the opening and closing member is satisfied.

* * * * *